US006488488B2

(12) United States Patent
Achtelik et al.

(10) Patent No.: US 6,488,488 B2
(45) Date of Patent: Dec. 3, 2002

(54) ROTARY HELICAL SCREW-TYPE COMPRESSOR HAVING AN INTAKE FILTER AND MUFFLER

(75) Inventors: Carsten Achtelik, Dinslaken (DE); Karl-Heinz Gilfert, Oberhausen (DE); Arno Heinz, Oberhausen (DE); Walter Murmann, Oberhausen (DE)

(73) Assignee: GHH-Rand Schraubenkompressoren GmbH (DE)

( * ) Notice: Subject to any disclaimer, the term of this patent is extended or adjusted under 35 U.S.C. 154(b) by 0 days.

(21) Appl. No.: 09/950,323

(22) Filed: Sep. 10, 2001

(65) Prior Publication Data

US 2002/0048521 A1 Apr. 25, 2002

Related U.S. Application Data

(63) Continuation of application No. PCT/EP00/02152, filed on Mar. 10, 2000.

(30) Foreign Application Priority Data

Mar. 10, 1999 (DE) ..... 299 04 410 U

(51) Int. Cl.[7] ..... F04C 18/16; F04C 29/06

(52) U.S. Cl. ..... 418/47; 418/104; 418/181; 418/201.1

(58) Field of Search ..... 418/47, 104, 181, 418/201.1

(56) References Cited

U.S. PATENT DOCUMENTS

| | | | | |
|---|---|---|---|---|
| 3,101,171 A | * | 8/1963 | Fraser | 418/47 |
| 3,677,664 A | | 7/1972 | Wycliffe et al. | 418/9 |
| 4,174,196 A | | 11/1979 | Mori et al. | 418/9 |
| 4,563,138 A | | 1/1986 | Hofmann et al. | 418/97 |
| 4,957,417 A | | 9/1990 | Tsuboi | 418/201.1 |
| 5,139,396 A | | 8/1992 | Suzuki et al. | 417/423.4 |
| 5,454,700 A | * | 10/1995 | Iguchi et al. | 418/201.1 |

FOREIGN PATENT DOCUMENTS

| | | | | |
|---|---|---|---|---|
| DE | 480103 | | 11/1961 | |
| DE | 2938557 | | 4/1981 | |
| EP | 0037559 | | 10/1981 | |
| GB | 2299622 | | 10/1996 | |
| JP | 1-187391 | * | 7/1989 | 418/201.1 |
| JP | 5-113191 | * | 5/1993 | |
| RU | 1105692 | * | 7/1984 | 418/201.1 |

* cited by examiner

*Primary Examiner*—John J. Vrablik
(74) *Attorney, Agent, or Firm*—Michael Best & Friedrich, LLP

(57) ABSTRACT

The drive gear 19, 21 and the synchronizing gear 25, 27 for the two rotors 9,11 of a screw compressor are both located at the pressurized end of the rotor housing 3. At the suction end of the rotor housing 3 is only the bearing 53 for the suction side shaft journal 55, 57 that is free of oil lubrication. Inlet openings 13 in a suction side inlet housing are located in such a way that the intake air cools the oil-free shaft bearing 53. Each shaft journal has a tool interface 63 accessible through the inlet housing on which to attach a rotating tool. The inlet housing 4 can be removed from the shaft journal 55, 57 together with the bearing 53 and seal 87, for example to exchange the bearing, without having to remove the rotors 9, 11 or without throwing off their adjustment.

5 Claims, 7 Drawing Sheets

1
a
9
19
91
97
95
29
93
107
113
27
17
b
103
101
105
109
23
11
21
25
113
3

ROTARY HELICAL SCREW-TYPE COMPRESSOR HAVING AN INTAKE FILTER AND MUFFLER

This application is a continuation of PCT/EP00/02152 filed Mar. 10, 2000.

FIELD OF THE INVENTION

This invention pertains to a screw compressor. The invention preferably, but not exclusively applies to a screw compressor used to produce a pressurized air stream for pneumatic transport of bulk materials. In particular, the invention applies to a screw compressor designed to be attached to a silo vehicle.

SUMMARY OF THE INVENTION

Screw compressors are air compressors that work on the positive displacement principle. They have advantageous characteristics as compared to other compressors that make them especially suitable for the pneumatic transport of bulk materials. This applies in particular for so-called dry-running screw compressors in which the screw rotors, which are synchronized by means of a synchromesh gear, do not make any contact with each other nor with the surrounding housing parts. Thus, there is no need for lubrication in the compression space so that this space can be kept oil free, preventing any oil contamination of the pressurized air. Also, since the rotors run without touching one another, there is no wear in this area that could reduce their lifespan. No abrasion arises that can contaminate the conveyed air. As a result of their operating characteristics, screw compressors are suited mainly for the achievement of high compression ratios. They are insensitive to short term pressure increases that could be caused by pluggage of the pipelines carrying the pressurized air. Finally, they are lightweight and compact, which makes them suited especially for mobile use, for example in silo vehicles.

In known screw compressors up until now, in particular for those used in silo vehicles, the drive gear for the rotors is located at one end and the synchronizing gear is located at the other end of the rotors. Oil lubrication is thus needed both at the pressurized end as well as at the suction end of the rotors. The intake of air is done through a filter and/or a muffler, which are designed as separate units from the compressor housing and are connected to the compressor housing through an intake line that opens up into it in the vicinity of the suction end of the rotor housing and passes around the synchronizing gear. The presence of oil lubrication at the suction side of the rotor housing is undesirable since it increases he danger of contamination of the air with oil. The design of the intake filter and/or muffler separated from the actual compressor housing does not lend itself to a compact, robust and low-weight design, depending on the requirements.

The purpose of this invention is to enable a simpler and improved air intake and a compact design of the compressor by improving the design of the screw compressor in the area of the suction end of the compressor housing.

By locating both the drive as well as the synchronizing gear on the pressure side of the rotor housing, oil lubrication can be eliminated completely at the suction end of the rotor housing. Furthermore, the area of the housing cover on the suction side surrounding the shaft journals and their bearing arrangement on the suction side of the rotors can be used directly for the inflow of air into the compressor space. In this area, there is no danger of contamination of intake air with oil. An intake housing containing the intake filter and/or the intake muffler can be directly attached to the suction end of the compressor housing, resulting in a compact, space-saving design that is especially robust for mobile use.

One embodiment form of the compressor according to the invention is explained in more detail with the help of the drawings.

BRIEF DESCRIPTION OF THE DRAWINGS

In all figures, the same parts, or corresponding parts, are shown with the same reference numbers.

DETAILED DESCRIPTION

Figure 1:
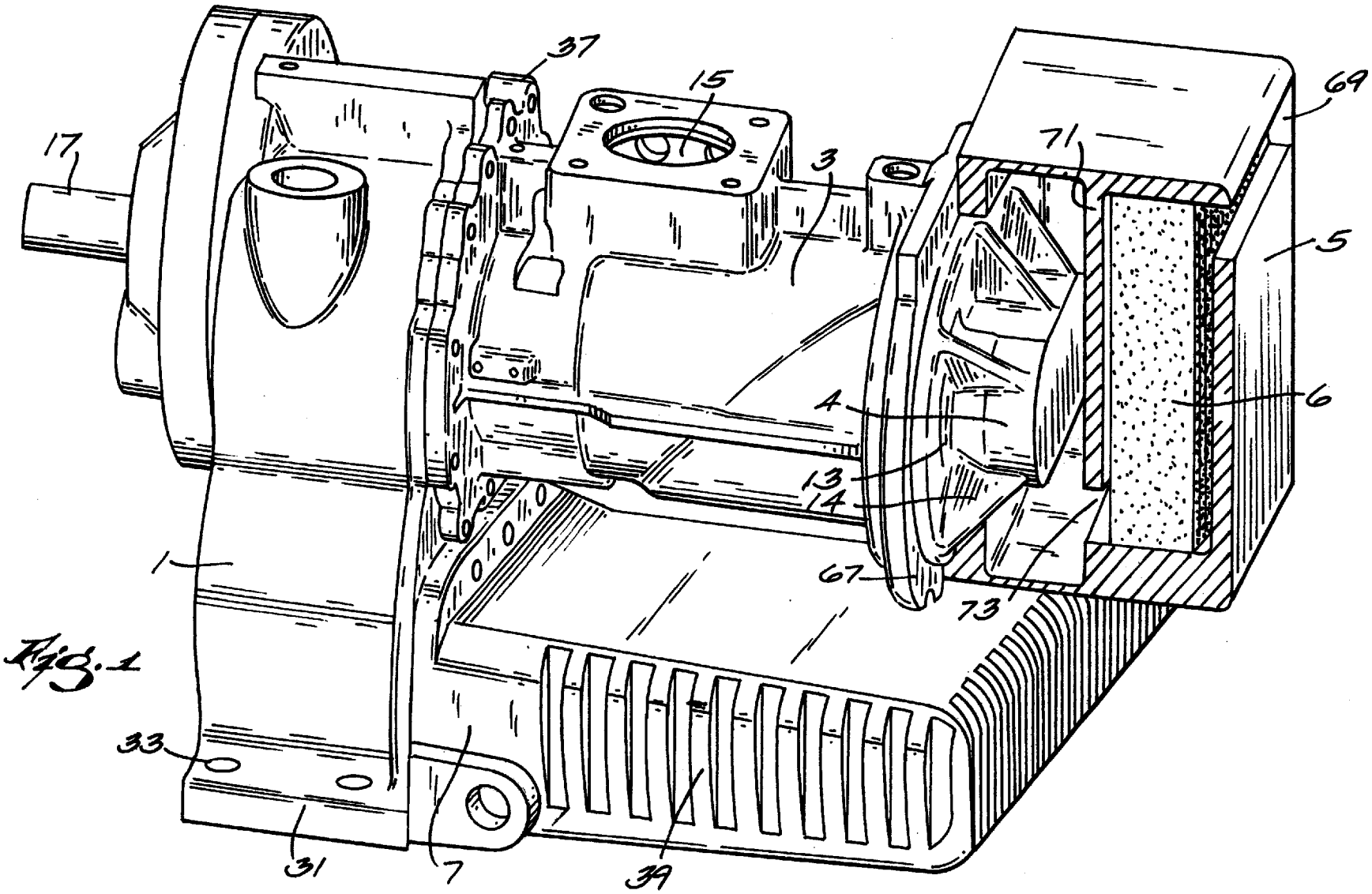
FIG. 1 a perspective view of the compressor with an intake filter as seen from the side.

The housing of the compressor illustrated in FIGS. 1–4 is made up of the following main parts; a gear housing 1, a rotor housing 3, an inlet housing 4, an intake housing 5, and an oil container 7. In the rotor housing 3 there are two rotors mounted on rotating bearings, namely a main runner 9 (toothed profile) and a secondary runner 11 (gapped profile). These rotors engage with one another by means of their screw-shaped teeth and tooth gaps, thus forming sealed chambers that move and shrink in the axial direction, thus compressing the intake air. During operation, the rotors are designed to run with their right end in FIGS. 1–3 being the suction side. Here, air intake comes through inlet openings 13 provided at the end face of the rotor housing 3. The air is conveyed in the axial direction to the left by the teeth and tooth gaps of the rotor pair as they engage with one another. It exits at the pressurized end of the rotors as compressed air at a pressure outlet 15 that is directed upward. The functioning principle of a screw compressor is known and is not explained here in more detail.

The gear housing 1 is shaped like a disc pedestal. The drive shaft 17 of the compressor is mounted there in bearings 16, 18. Its shaft journal 17*a* that extends out from the housing cover 49 is connected to a rotating drive unit that is not shown. The gear housing 1 also contains a set of drive gears that consists of a gear 19 fastened to the drive shaft 17 and a gear 21 that is fastened to the shaft journal 23 of the secondary runner 11. This gear set transfers the rotation of the drive shaft 17 to the secondary runner 11 at a suitable gear ratio. The synchronizing gear set that makes sure the two rotors run synchronously is also kept in the gear housing 1, i.e. it is also kept on the pressurized side of the rotors 9, 11. This synchronizing gear set consists of gears 25, 27 that engage together and are fastened to shaft journal 23 of the secondary runner and to shaft journal 29 of the main runner 9. The synchronizing gear set makes sure that the rotors 9, 11 engage one another with very little play, but without touching one another. This makes it possible to get by without any oil lubrication between the rotors 9, 11, i.e. to accomplish a dry running compressor. This is especially important if the compressor is to produce an air stream that is absolutely free of oil residue for pneumatic conveying of sensitive conveyed material.

The pedestal or disc-shaped gear housing 1 has overhanging attachment feet 31 at its bottom support surface on both sides with holes 33 for fastening screws. These feet fasten the entire compressor to a suitable support, for example a vehicle.

To provide continuous lubrication of the drive gear 19, 21 and of the synchronizing gear 25, 27, lubricating oil is sprayed into the area where the teeth of the two gears engage. This oil is continuously circulated using an oil pump 45. A required supply of oil is kept on hand in the oil container 7, which communicates with the interior of the gear housing 1. Seal arrangements 35 cooperate with the shaft journals 23, 29 of the rotors 9, 11. These seal arrangements prevent oil from entering the rotors 9, 11 and thus from entering the compression space of the compressor. Since the drive gear 19, 21 and the synchronizing gear 25, 27 are both located on the pressure side of the rotors 9, 11 and since the suction side bearings of the rotors are grease-filled, as will be explained below, no oil lubrication is needed at the suction side of the rotors (to the right in FIGS. 1–3). Therefore no oil lines are required through which oil can circulate from the pressure side to the suction side of the rotor and back, as in common screw compressor designs.

Figure 3:
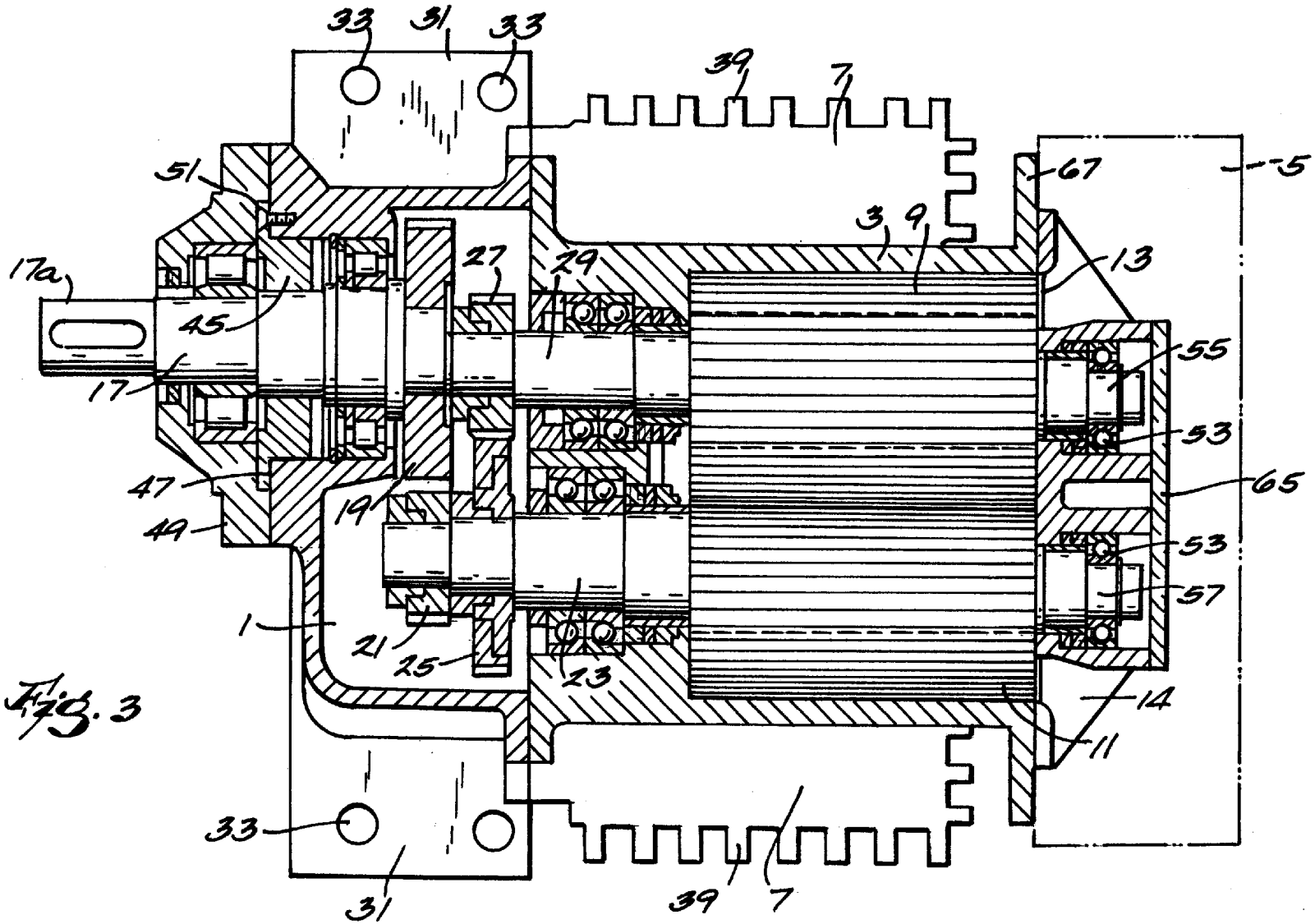
FIG. 3 a horizontal section through the compressor in the plane containing both rotor axes.

As can be seen in FIG. 1 and FIG. 3, the rotor housing 3 is fastened to the gear housing 1 by means of a flange connection 37 such that it freely projects out from the gear housing 1. The oil container 7, which has a flat box shape, is also attached to the gear housing 1 such that it freely projects out from it as well approximately parallel to the rotor housing 3 and beneath the same. The sidewalls of the oil container 7 are provided with cooling ribs 39. Between the oil container 7 and the bottom of the rotor housing 3 is a relatively broad air gap 41. With the rotor housing 3 and the oil container 7 arranged in this way relative to one another and to the gear housing 1, the heat transfer, in particular through conduction, from the rotor housing 3 to the oil container 7 is reduced to a minimum. This prevents the heat produced in the rotor housing 3 during operation of the compressor due to the air compression from resulting in undesired heating of the oil supply in the oil container 7, even though the oil container 7 is directly connected to the gear housing. By directly fastening (flange connection) the oil container 7 to the gear housing 1, it can communicate with the gear housing 1 through a large opening 43. Special oil lines are not necessary.

An oil pump 45 is used to circulate the oil inside the gear housing 1 and to produce an oil mist. The pump surrounds the drive shaft 17, which drives it. The housing of the oil pump 45 has a flange 47 projecting outward that centers the housing cover 49 fastened to the gear housing 1. The oil pump 45 is attached to the gear housing 1 with 4 screws 51 (FIG. 3) and associated threaded holes.

As a result of the arrangement of the drive gear 19, 21 and synchronization gear 25, 27 on the pressure side of the rotors 9, 11, only the bearings 53 for the shaft journals 55, 57 on the suction side of the rotors are located there. They are located in an inlet housing 4 that closes off the rotor housing 3 on the suction side. The inlet openings 13 that lead to the interior of the rotor housing 3 are designed in this inlet housing between support ribs 14. Seal arrangements 61 that cooperate with the shaft journals 55, 57 are mounted in front of the bearings 53. These will be discussed below.

The ends of the suction side shaft journals 55, 57 of the rotors 9, 11, which extend beyond the bearings 53, are provided with a tool interface for the attachment of a rotating tool. In the embodiment example shown in FIG. 6, the tool interface consists of two flats 63 on which to place an open-end wrench. However, the tool interface can also take the form of a square end, a hexagonal end, a recessed hexagonal socket or similar. The shaft journals 55, 57 containing the tool interface are easily accessible by removing a housing cover 65 fastened on top of the inlet housing 4 with screws.

By attaching a rotating tool to one or both of the suction side shaft journals of the rotors 9, 11, it is possible to rotate them by hand and thus to remedy a blockage of the rotors which can occur if dust material that is to be conveyed by the pressurized air stream produced by the compressor makes its way inside the rotor housing 3 and between the rotors 9, 11 as a result of material backlash. A blockage of this kind can not generally be fixed by rotating the drive shaft journals 17*a*, since the drive gear 19, 21 has too high of a gear ratio.

Figure 2:
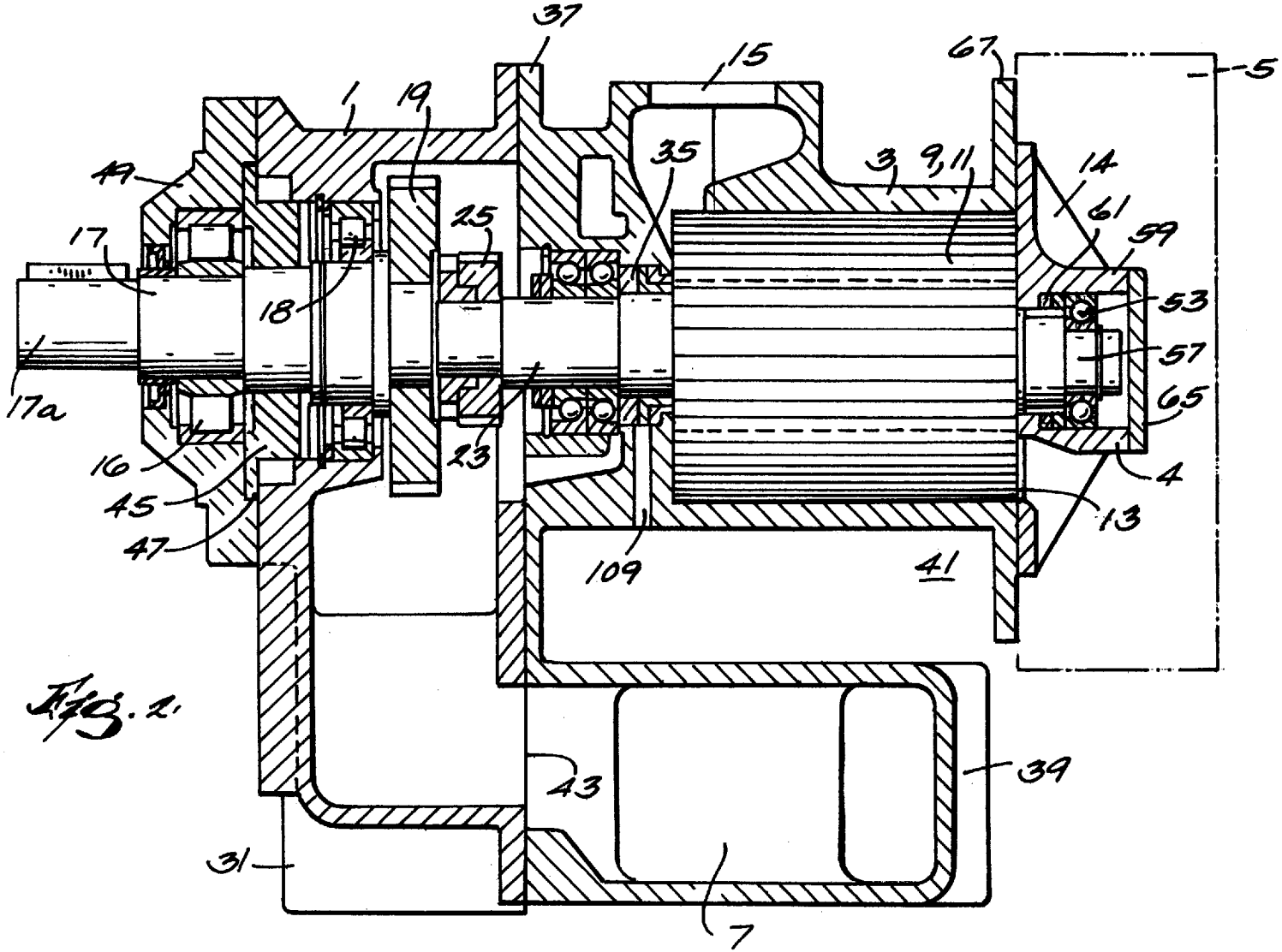
FIG. 2 a vertical section through the compressor of FIG. 1.

The inlet housing 4 that closes off the rotor housing 3 on the suction side and that has the inlet openings 13 is surrounded by a large-volume intake housing 5 at a distance (shown in FIG. 2 and FIG. 3 by dashed lines only). This intake housing is attached to a flange 67 of the rotor housing 3 by means of screws. In this intake housing 5, which is directly attached to the rotor housing 3, is an intake filter to filter the intake air and/or a muffler to dampen noise. In the embodiment form shown in FIG. 1, the intake housing 5 contains a filter 6 made of a suitably porous or air-permeable filter material. The filter sits in an airflow path between an outer intake slot 69 and a feed-through slot 73 located along an interior separating wall 71. The intake slot 69 and the feed-through slot are offset from one another such that as long a flow path as possible is formed for the air between the slots 69, 73 and through the filter 6.

Figure 5:
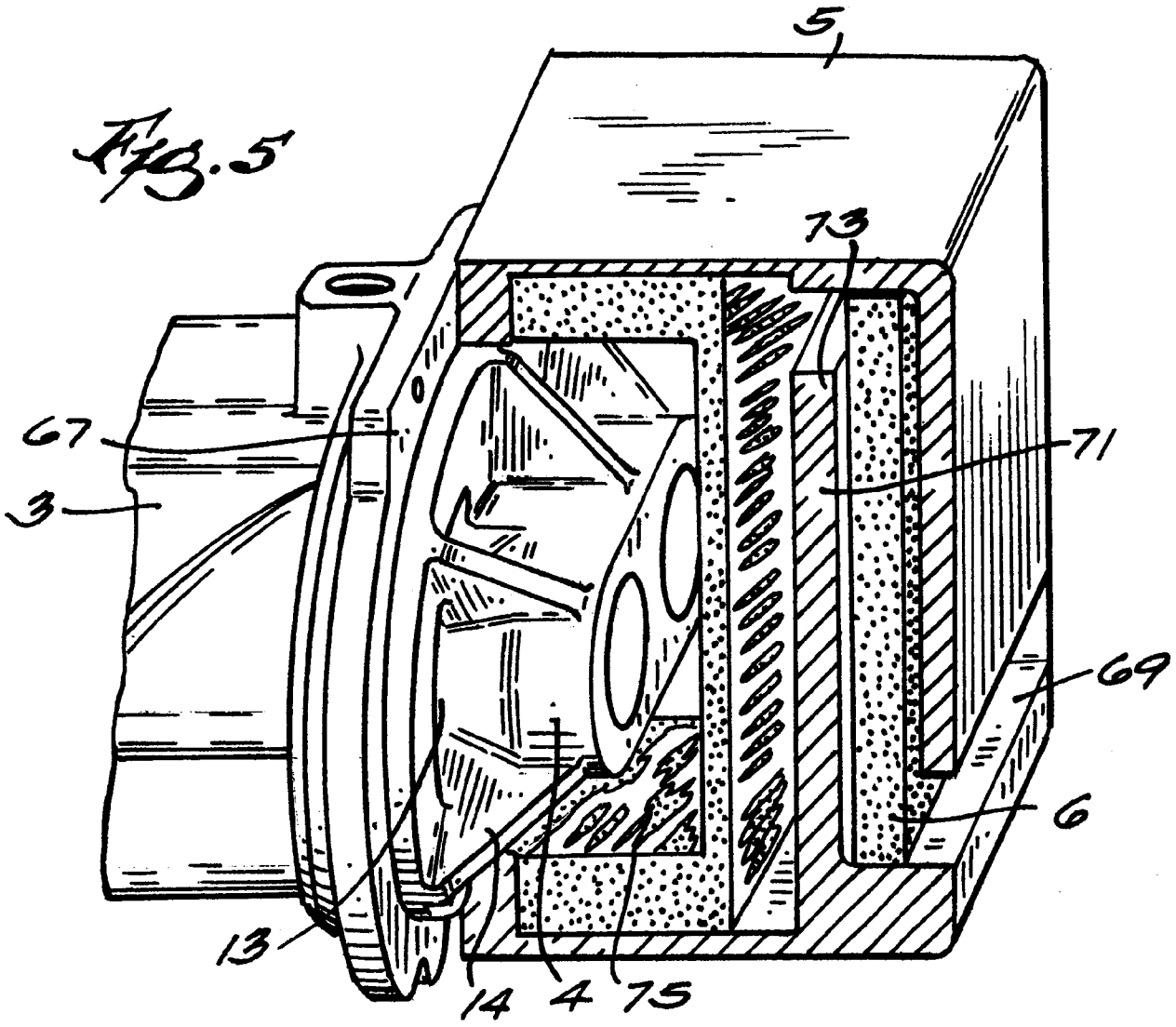
FIG. 5 a detail of the perspective view of FIG. 1 with a modified embodiment form of the intake housing.

In FIG. 5, a modified embodiment form of the intake housing 5 is shown. The air intake comes through the intake slot 69 and is redirected by the baffle wall 71 containing the feed-through slot 73 and flows through a muffler 75 that is made of suitable perforated sheeting. It then flows into the surrounding space of the housing cover 69 and flows through the inlet openings 13 into the interior of the rotor housing 3. It is also possible to design the intake housing 5 such that it contains both a filter 6 as well as a muffler 75.

An advantage of directly attaching the intake housing 5 containing a filter and/or a muffler to the rotor housing 3 in such a way that it surrounds the inlet housing 4 at a distance is that there is no need for a separate arrangement of a filter and/or muffler, nor is there need for a connecting line between it and the suction side of the compressor. This allows an especially simple, compact and robust arrangement. Another advantage is that the air intake into the intake housing 5 flows around and cools the exterior side of the inlet housing 4 containing the shaft journal bearings before it enters the interior of the rotor housing 3 through the inlet openings 13. In this way, the suction side rotor bearings are effectively cooled.

Figure 6:
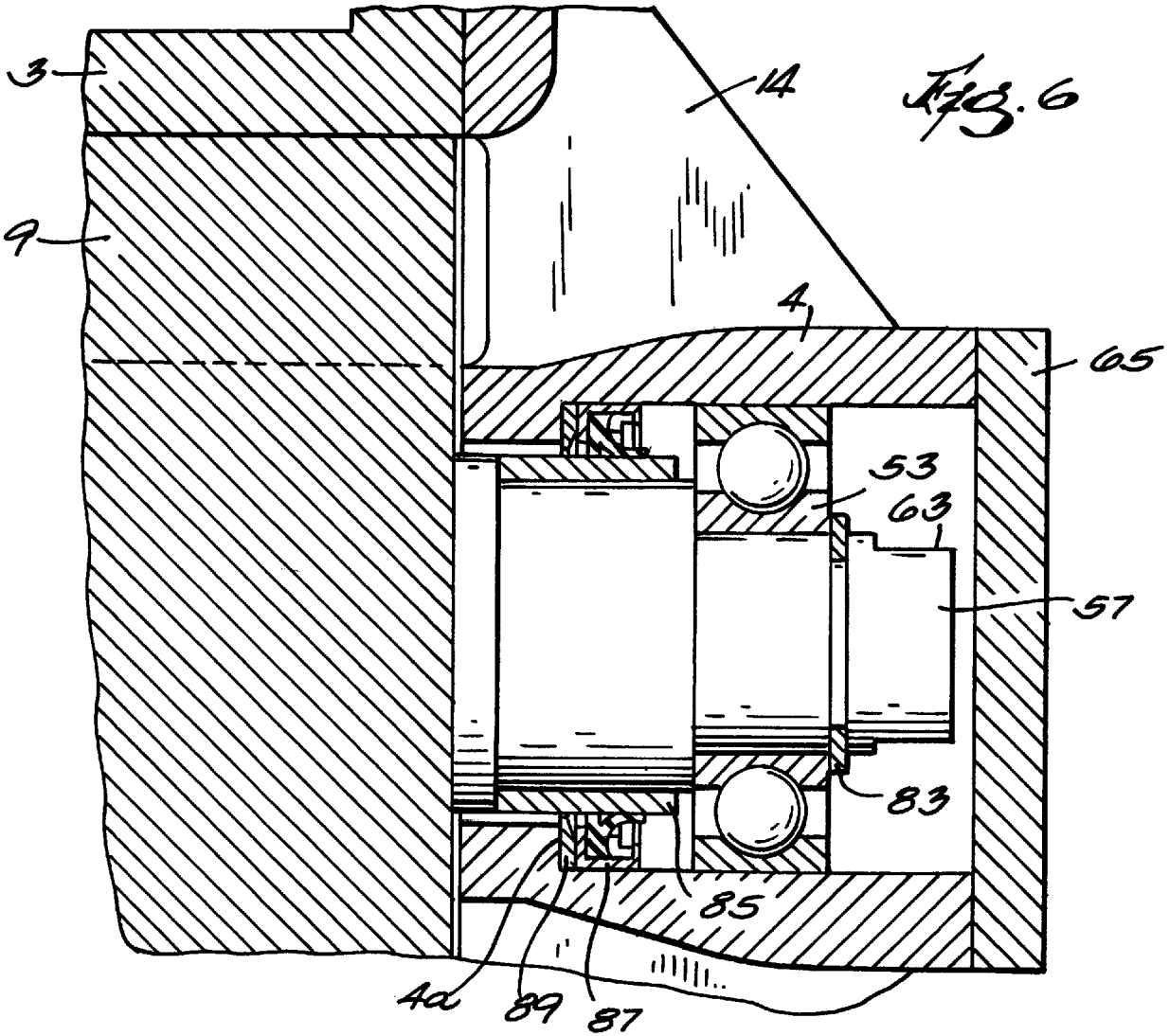
FIG. 6 an enlarged detail of the sectional representation of FIG. 2 in the suction side rotor bearing area.

FIG. 6 shows an enlarged sectional representation of the bearing and seal of shaft journal 55 of rotor 9 inside the inlet housing 4. The shaft journal 57 of the other rotor 11 is mounted and sealed in the same way. The shaft journal 57 with the tool interface (flats 63) is mounted in the center section of the inlet housing 4, this section being designed similar to a hub, by means of a roller bearing 53 located between a shoulder of the shaft journal 57 and a retaining ring 83 engaged in an annular notch in the shaft journal. Since no oil lubrication of any kind is to take place on the suction side of the rotors 9, 11, as illustrated above, it is preferable to design the roller bearing 53 as an encapsulated bearing with a lifetime grease filling so that it will never need any subsequent lubrication. A race 85 is fastened to the shaft journals 57 next to the roller bearing 53, preferably shrunk on. The race 85, which for example can be a common roller bearing race, is made of steel with a specially hardened peripheral surface. Two lip seals of a lip seal ring 87 cooperate with this race. This lip seal ring seals the interior of the rotor housing 3 off from the roller bearing 53. On the side of the lip seal ring 87 facing the rotor housing 3 is a guard ring 89 between it and an internal shoulder 4*a* of the inlet housing 4. The internal perimeter of the guard ring sits opposite to the external surface of the race 85 with a very small gap, but does not touch. The guard ring 89 and the lip seal ring 87 are fixed against one another and against the inner shoulder 4*a* of the inlet housing 4 in the recess of the housing, preferably glued in.

The function of the guard ring 89 is as follows: during operation the compressor produces a pressurized air stream by intake air coming into the suction side and compressed exhaust air exiting at the pressure collar 15. This pressurized air stream can be used for pneumatic transport of bulk powders, for example. In case of operational disruptions, a backlash of compressed air can occur from the pressure side to the suction side of the rotors, which presents the danger that particles of the powdered material carried by the air stream can travel into and out of the rotor housing 3 up to the shaft journals of the rotors. The guard ring 89 protects the lip seal ring 87 against this kind of material backlash when it occurs, preventing dust particles from reaching under the lip seals of the lip seal ring 87 and compromising the sealing effect.

The suction side bearing arrangement shown in FIG. 6 and described above has the further advantage in that these bearings can be removed from the shaft journal 57 without having to remove the rotor 9 or 11 or without having to change the precise setting of the rotors with respect to one another. Removing the bearing and seal arrangement from the shaft journal can be done in the following way:

After removing the intake housing 5, the housing cover 65 of the inlet housing 4 is removed so that the shaft journal 57 is accessible with its retaining ring 83. The retaining ring 83 is removed. Then, the screws connecting the inlet housing 4 to the rotor housing 3 are removed. Now, the entire inlet housing 4 together with the roller bearings 53, lip seal rings 87 and guard rings 89 contained in it can be removed. This allows the suction side roller bearings 53, which are those parts that must be exchanged soonest due to the limited shelf life of their grease filling, to be easily changed out without having to change the rotors' 9, 11 adjustment with respect to one another and to the housing or even to remove them at all.

Figure 7:
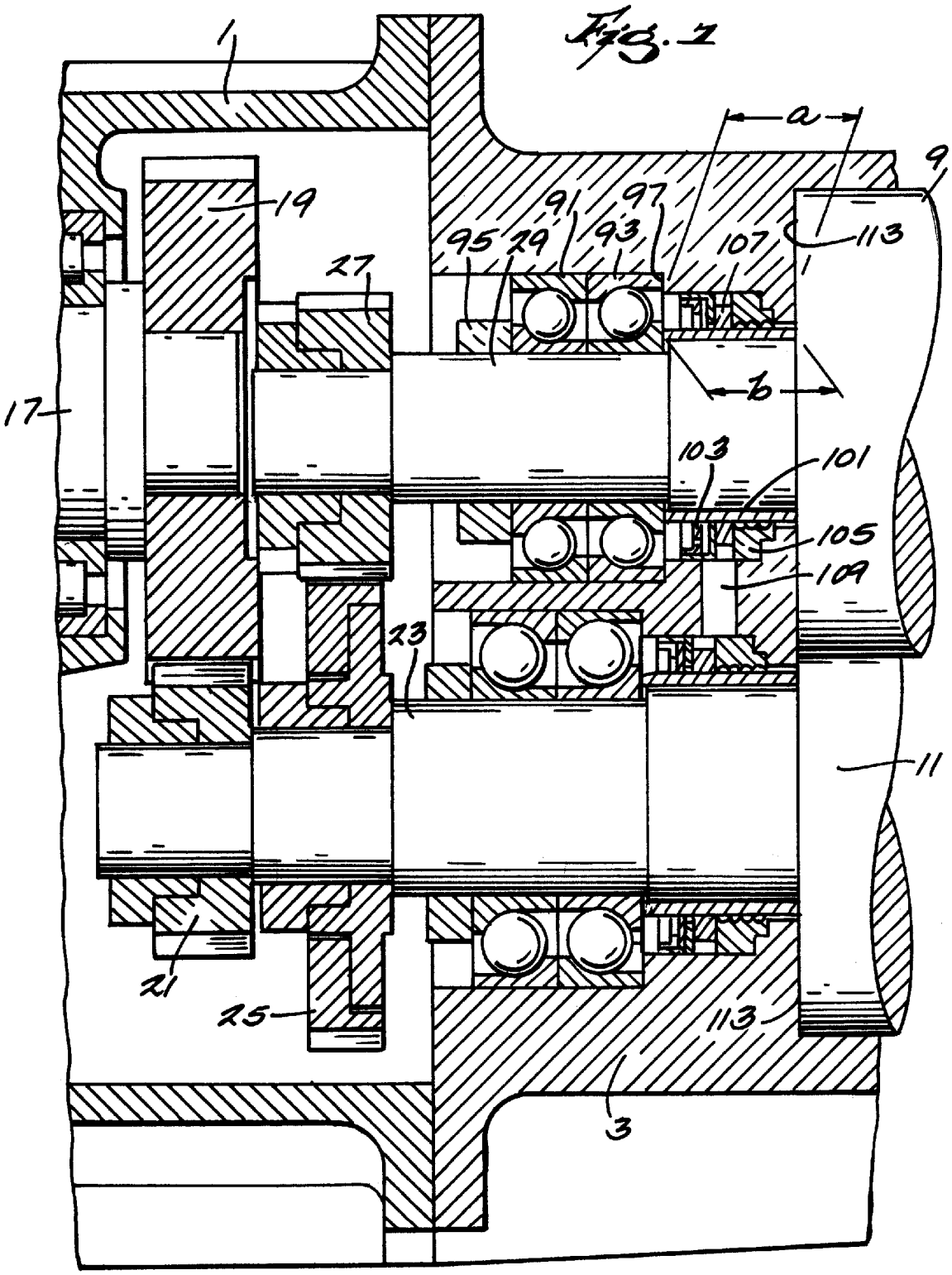
FIG. 7 an enlarged detail of the sectional representation of FIG. 3 in the pressure side rotor bearing area.

FIG. 7 shows the bearing and seal arrangement of the pressure side shaft journals 29, 23 of the rotors 9, 11 at the pressure end of the rotor housing 3 in a sectional representation similar to FIG. 3, but at a larger scale. Below, the bearing and seal arrangement for shaft journal 29 of rotor 9 is described. The description for shaft journal 23 of rotor 11 is designed exactly the same.

Shaft journal 29 is mounted in the pressure side end wall of the rotor housing 3 by means of two roller bearings 91, 93 arranged next to one another. These roller bearings are designed as so-called angular contact ball bearings. Angular contact ball bearings commonly available commercially are ball bearings whose balls are held in place by the external race on one side and by the internal race on the other side of the ball's radial center plane. The two angular contact ball bearings 91, 93 are arranged next to one another with mirror image symmetry. This type of arrangement of angular contact ball bearings is characterized in that it is completely free of play in the axial direction. A shaft nut 95 located on the shaft journal 29 fixes the angular contact ball bearings 91, 93 on shaft journal 29 in the axial direction. The external race of angular contact ball bearing 93 sits against an inner shoulder 97 of the rotor housing 3.

A section of shaft journal 29 is located between angular contact ball bearing 93 and the rotor 9. A race 101 is fastened to this section, being preferably shrunk on. This race 101, just as the race 85 described before in FIG. 6, is made of steel with a specially hardened perimeter surface. Against the surface of the race 101 lie the lip seals of a lip seal ring 103. This lip seal ring seals the compression space of the rotor housing 3 from the gear and bearing areas subjected to oil. The hardened and extremely precisely machined, e.g. polished, exterior surface of the race 25 results in an especially low-wear bearing surface for the lip seals of the lip seal ring 103.

Furthermore, between the lip seal ring 103 and the rotor 9 is a labyrinthine seal ring 105 that has a number of annular ribs next to one another on its inner perimeter that face the exterior surface of the race 101 with a very small gap but without touching it. These annular ribs form a labyrinthine gap together with this surface. Although the race 101 normally does not touch the labyrinthine sealing ring 105, it is nevertheless advantageous for the race 101 to also extend along the area of the labyrinthine seal ring 105. The labyrinthine gap seal is normally a non-contact seal, but under extreme operation conditions, contact can under certain conditions occur between the annular ribs of the labyrinthine seal ring 105 and the race 101. If the race 101 were not present, grooves would be produced on the shaft journal 29 as a result so that it becomes damaged and the rotor 9 becomes unusable. Thanks to the existence of the race 101, only the race 101 needs to be changed in this case so that the rotor 9 can be reused as it is otherwise free of damage.

Between the labyrinthine seal ring 105 and the lip seal ring 103 is an annular breather space 107 that is connected to the atmosphere through a ventilation channel 109 (see FIG. 7 and FIG. 2). The ventilation channel 109 designed in the interior of the rotor housing 3, which is the so-called lantern, runs from a point between the two shaft journals 29, 23 of the rotors 9, 11 downward and opens up at the bottom of the rotor housing 3. The top of the oil container 7 with the cooling ribs 39 sits opposite to the opening of the lantern 109 at a distance. The oil container 7 blocks a straight access path to the opening of the lantern 109 from below.

Figure 4:
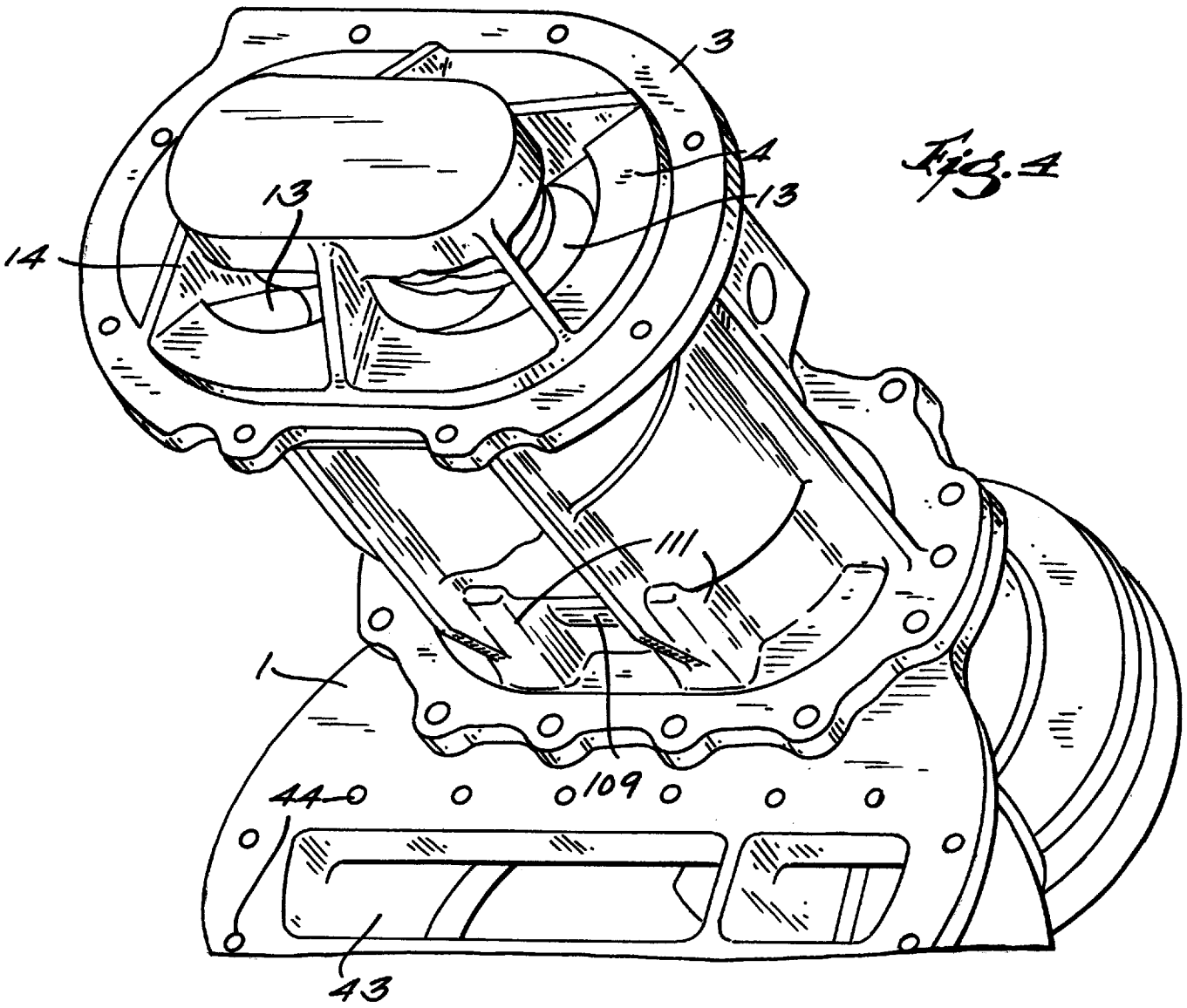
FIG. 4 another perspective representation of the compressor from below as seen from the suction end with the intake housing and the oil container removed.

FIG. 4 shows a perspective view from below of the compressor with the oil container 7 removed so that the screw holes 44 for fastening the oil container 7 and the large connection opening 43 that allows the oil container to communicate with the gear housing are visible in the rear wall of the gear housing 1. Further, in FIG. 4, the intake housing 5 is removed from the suction side of the rotor housing 3 so that the view is free of the inlet housing 4 with its support ribs 14 and the inlet openings 13 leading to the interior of the rotor housing 3. FIG. 4 also shows the opening of the lantern (ventilation channel) 109 at the bottom of the rotor housing 3. As can be seen in FIG. 4, shoulders 111 are provided on both sides of the opening of the lantern 109 at the bottom of the rotor housing 3. These shoulders shield the opening of the lantern 109 against straight access from the side. These shoulders 111 can be formed from oil discharge channels. The opening of the lantern 109 is thus located at a protected position, straight access to which exists neither from below (due to the oil container 7) nor from the side (due to the shoulders 111). In this way, for example, high-pressure water jets cannot be pointed directly at the opening of the lantern 109 when cleaning the compressor using high-pressure spray equipment. This would result in water entering the annular space 107 and thus into the area of the lip seal ring 103 and the labyrinthine seal ring 105.

As can be explained by means of FIG. 7, the race 101 attached to shaft journal 29 also serves as a spacer that maintains a very exactly dimensioned gap between the pressure side rear face of the rotor 9 or 11 and the rear face 113 of the rotor housing 3 facing it. A deciding factor in the efficiency of the compressor is as small and as exactly defined as possible a gap at the pressure side rear face of the rotor 9 or 11. According to the invention, the precise setting and maintenance of this gap is done by first preparing distance a between the rear face 113 facing rotor 9 and the bearing shoulder 97 for roller bearing 93 to a prescribed value with very tight tolerances when the rotor housing 3 is machined. Length b of race 101 which is used as a spacer between the roller bearing 97 and the rear face of rotor 9, is also ground, with the same exacting tolerances, to a value that is in excess of distance a corresponding exactly to the width of the gap to be established between the rotor 9 and the rotor housing 3. Adjusting the gap through the length difference of distances a and b is possible because angular contact ball bearings 91, 93 are used in a symmetrical arrangement according to the invention. These angular contact ball bearings result in a bearing arrangement that is completely free of axial play, as mentioned above. Since the bearing surfaces between the exterior bearing ring and the housing shoulder 97 on the one hand and between the inner bearing ring of roller bearing 93 and the race 101 on the other hand thereby act as axial reference surfaces that are free of play, a correspondingly exact adjustment of the rotor rear gap is obtained by the sufficiently exact machining of distance a of the housing shoulders and length b of race 101. The one-time adjustment of the rotor rear gap remains even with temperature changes since the influence of the different heat expansions of the rotor housing 3 and race 101 is negligibly small. The previous adjustment of the rotor rear gap required during installation of compressors of this type by inserting shim rings of various thicknesses corresponding to the manufacturers' tolerance fluctuations is eliminated.

We claim:

1. A screw compressor with two rotors mounted in a rotor housing (3) with parallel axes, that engage one another with screw-shaped teeth and tooth gaps, and that convey air during operation from a suction end toward a pressure end of the rotor housing (3) and in the process compress the air, with a gear housing (1) located at one end of the rotor housing (3) in which a drive shaft (17) is mounted with drive gears (19, 21) for the rotors (9, 11) and in which oil lubrication is provided for the drive gears, and with a synchronizing gear (25, 27) that couples the rotors (9, 11) to run together in opposite directions synchronously without touching, characterized in that the drive gear (19, 21) and the synchronizing gear (25, 27) are both located in the gear housing (1) on the pressurized end of the rotor housing (3) and that bearings (53) for suction side shaft journals (55, 57) of the rotors (9, 11) are free of oil lubrication and are located in an inlet housing (4) that closes off the rotor housing (3) at the suction end, said housing exhibiting inlet openings (13) for the air intake by the rotors (9, 11) in a way that allows the section of the inlet housing (4) containing the bearings 53 to be cooled by means of the intake air, and that the inlet housing (4) is surrounded at a distance by an intake housing (5) attached to the rotor housing (3) that has at least one intake opening (69) and in which is located a filter (6) and a muffler insert (75) in the flow path of the air from the intake opening (69) to the inlet openings (13).

2. A screw compressor according to claim 1, wherein each of the bearings (53) for the suction side shaft journal (55, 57) of the rotors (9, 11) is an encapsulated roller bearing with a lifetime grease filling.

3. A screw compressor according to claim 1, wherein the inlet housing (4) has holes (66) through which the shaft journals (55, 57) of the rotors (9, 11) can be accessed, and that a tool interface (63) is designed into each shaft journal (55, 57) on which to place a rotating tool.

4. A screw compressor according to claim 1 wherein the inlet housing (4) has holes (66) through which the shaft journals (55, 57) of the rotors (9, 11) can be accessed, and that a retaining ring (83) that secures the bearing (53) to the shaft journal (55, 57) can be accessed through the holes (66) in such a way that the retaining ring (83) can be removed from the shaft journal (55, 57) and then, after removing any attaching screws, the inlet housing (4) and the bearing (53) and any seals (87) can be removed from the shaft journal (55, 57).

5. A screw compressor according to claim 1 wherein each suction side shaft journal (55, 57) is sealed in the inlet housing (4) by means of a lip seal ring (87) that sits against the shaft journal or a race (85) located on the shaft journal, and that between the lip seal ring (87) and the rotor housing is a guard ring (89) that sits opposite the perimeter surface of the shaft journal or race (85) with a minimal separation without touching the shaft journal or race (85).

* * * * *